US009016667B2

(12) United States Patent
Krappinger et al.

(10) Patent No.: US 9,016,667 B2
(45) Date of Patent: Apr. 28, 2015

(54) CABLE WINCH DEVICE

(75) Inventors: Reinhard Krappinger, Höchst (AT); Eugen Schobesberger, Röthis (AT); Alexander Köhler, Feldkirch (AT)

(73) Assignee: Liebherr-Werk Nenzing Ges.m.b.H., Nenzing (AT)

( * ) Notice: Subject to any disclaimer, the term of this patent is extended or adjusted under 35 U.S.C. 154(b) by 153 days.

(21) Appl. No.: 13/609,933

(22) Filed: Sep. 11, 2012

(65) Prior Publication Data

US 2013/0248789 A1 Sep. 26, 2013

(30) Foreign Application Priority Data

Sep. 12, 2011 (DE) ..... 10 2011 113 208

(51) Int. Cl.
*B66D 1/00* (2006.01)
*B66D 1/28* (2006.01)
*B66D 1/36* (2006.01)

(52) U.S. Cl.
CPC . *B66D 1/28* (2013.01); *B66D 1/365* (2013.01)

(58) Field of Classification Search
USPC ..... 254/268, 329, 332
See application file for complete search history.

(56) References Cited

U.S. PATENT DOCUMENTS

| | | | | |
|---|---|---|---|---|
| 4,050,587 | A * | 9/1977 | Moen | 212/301 |
| 4,878,607 | A * | 11/1989 | Lessard | 226/24 |
| 7,267,241 | B2 * | 9/2007 | Franzen et al. | 212/278 |
| 7,309,060 | B2 * | 12/2007 | Baughman et al. | 254/332 |
| 7,458,113 | B2 * | 12/2008 | Milam | 5/81.1 HS |
| 8,684,335 | B2 * | 4/2014 | Hayes | 254/323 |
| 2005/0224774 | A1 * | 10/2005 | Lundrigan | 254/329 |

FOREIGN PATENT DOCUMENTS

| | | | |
|---|---|---|---|
| DE | 2309546 | A1 | 9/1973 |
| DE | 256500 | A1 | 5/1988 |
| EP | 1862636 | A1 | 12/2007 |
| FR | 1158317 | A | 6/1958 |
| FR | 2417466 | A1 | 9/1979 |

* cited by examiner

*Primary Examiner* — Emmanuel M Marcelo
(74) *Attorney, Agent, or Firm* — Dilworth & Barrese, LLP

(57) ABSTRACT

A cable winch device, in particular a cable winch device of a crane with at least one cable winch, with at least one cable, wherein the cable is at least partly wound up on the cable winch and/or can be wound up and/or unwound, and with at least one tilting means by means of which the cable which can at least partly be tilted and/or pivoted about an axis which is substantially parallel to the longitudinal axis of the cable winch. A crane is also disclosed herein.

20 Claims, 1 Drawing Sheet

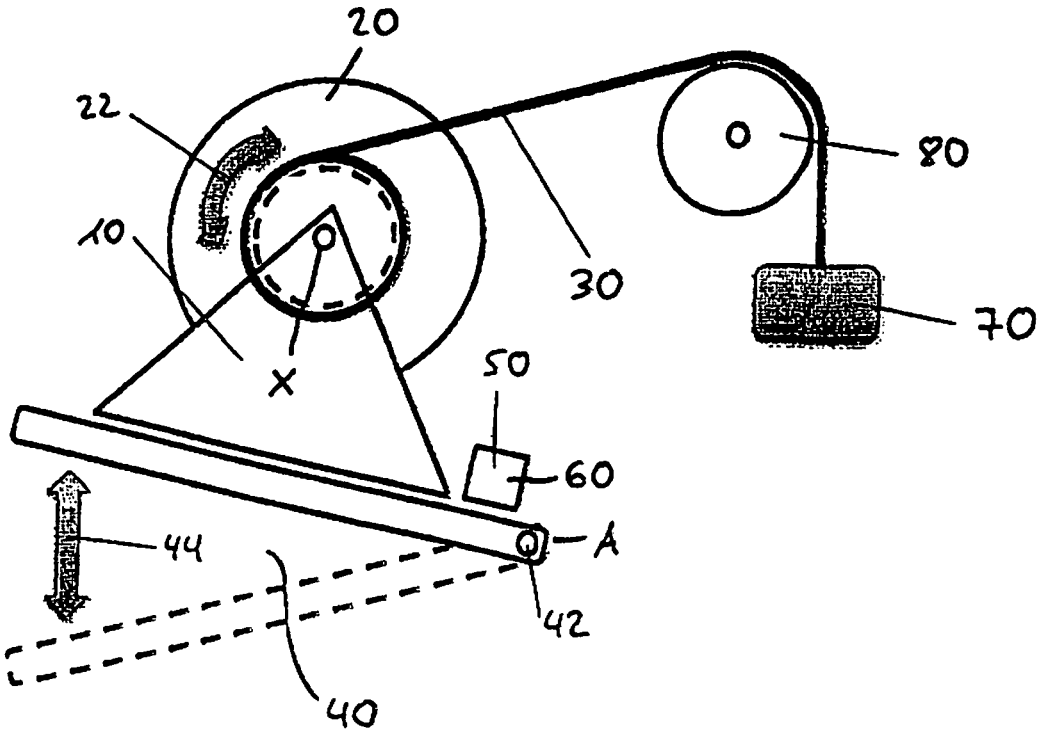
20
22
10
X
30
80
70
50
60
A
44
42
40

CABLE WINCH DEVICE

BACKGROUND OF THE INVENTION

The present invention relates to a cable winch device, in particular a cable winch device of a crane with at least one cable winch, with at least one cable, wherein the cable is at least partly wound up on the cable winch and/or can be wound up and/or unwound, and to a crane with at least one cable winch device.

Cranes, such as deep-sea cranes, but in principle also any cranes which have a main working range in the transition from one position to another position, include at least one cable winch device or a reeling device, which operates in particular in the hoisting gear operation.

In the hoisting gear operation at certain hook heights it may occur that the cable constantly operates in the alternation of two positions and due to the increased surface pressure in this region thus is subject to an increased wear. This increased wear reduces the useful life of the cable and thus leads to a premature failure of the cable.

In principle, however, it is desirable to increase the useful life of the cable of a crane, as a replacement is expensive and therefore involves comparatively high costs.

SUMMARY OF THE INVENTION

Therefore, it is the object of the present invention to develop a cable winch device as well as a crane as mentioned above in an advantageous way, in particular to the effect that the wear of the cable of a crane in hoisting gear operation is reduced and the useful life of the cable can be increased thereby.

In accordance with the invention, this object is solved by a cable winch device with the features herein. Accordingly, it is provided that a cable winch device is provided with at least one cable winch, with at least one cable, wherein the cable is at least partly wound up on the cable winch and/or can be wound up and/or unwound, and with at least one tilting means by means of which the cable winch can at least partly be tilted and/or pivoted about an axis which is substantially parallel to the longitudinal axis of the cable winch.

In particular, this can be the cable winch device of a crane, e.g. a deep-sea crane, but in principle the cranes can be any type of cranes.

In particular, this involves the advantage that the wear of the cable of a crane in hoisting gear operation can be reduced and as a result the useful life of the cable can noticeably and distinctly be increased.

For example, when tilting the cable winch of a crane by at least the angle of the range of ascent of the cable on the flanged wheel, the main working range can be moved out of this region.

In particular, it is advantageous that for this kind of displacement of the main working range, no change of the boom position is necessary, whereby no change of the lifting capacity, which is changed correspondingly with a change in the boom position, must be taken into account.

It is possible that at least one electronic actuating means is provided, by means of which the tilting means can be actuated. The at least one electronic actuating means for example can be an electronic actuator of the tilting means. This actuator can be an independent actuator or also a part of the controller of the cable winch device.

Furthermore, it is conceivable that at least one position detection means is provided, by means of which the current hoisting height of a load lifted with the cable winch device and/or the turn of the cable on the cable winch is directly and/or indirectly recognizable and/or detectable.

Furthermore, it can be provided that the current hoisting height of a load lifted with a cable winch device and/or the turn of the cable on the cable winch is automatically recognizable and/or detectable by means of the at least one position detection means. Advantageously, e.g. both the current hoisting height and the turn of the cable on the cable winch thus can automatically be detected via the crane controller by means of the position detection means. Thus, tilting of the cable winch and hence a compensation of the hoisting height can be effected without manual intervention of the crane operator. Thus, the system in particular provides for the cable-conserving operation, for example without having to make a change in the boom position. As a result, no change in the lifting capacity must be observed.

It is also possible that the at least one position detection means is connectable and/or connected with the electronic actuating means and/or that the position detection means is part of the electronic actuating means.

In addition, it can be provided that the tilting means includes at least one tilt joint and/or at least one drive means.

Furthermore, it is advantageously conceivable that the cable winch includes at least one cable winch drive means by means of which the cable winch is rotatable such that the cable can be wound up and/or unwound.

Furthermore, the present invention relates to a crane with the features herein. Accordingly, it is provided that a crane is provided with at least one cable winch device according to the description herein.

The crane can be a deep-sea crane, but in principle the cranes can be any type of cranes.

Particularly advantageously, a crane according to the invention can be used in an environment in which the crane has a main working range in the transition of one position to another position.

BRIEF DESCRIPTION OF THE DRAWING

Further details and advantages of the invention will now be explained in detail with reference to an exemplary embodiment illustrated in the drawing.

The only FIGURE shows a schematic representation of the cable winch device for a crane according to the invention.

DESCRIPTION OF THE PREFERRED EMBODIMENTS

FIG. 1 shows a schematic representation of a cable winch device 10 according to the invention in an advantageous embodiment with a cable winch 20 on which a cable 30 is partly wound up.

There is provided a tilting means 40 by means of which the cable winch 20 can at least partly be tilted and/or pivoted about an axis A, which is substantially parallel to the longitudinal axis X of the cable winch 20. The tilting means 40 includes one or more, preferably two tilt joints 42 and one or more drive means 44. The drive means 44 for example is a linear drive or a rotary drive and according to the embodiment shown in FIG. 1 a hydraulically actuated hoisting cylinder 44. In principle, however, the drive means can be a hydraulic, pneumatic or electric or some other suitable drive means.

The cable winch 20 includes at least one cable winch drive means 22 by means of which the cable winch is rotatable such that the cable 30, which for example is guided over the cable pulley 80, can be wound up and unwound. Via the cable winch drive means 22, as will yet be explained below, the hoisting height of the load 70 can be corrected.

The cable winch device 10 includes an electronic actuating mean 50 by means of which the tilting means 40 can be actuated. Furthermore, a position detection means 60 is provided, by means of which the current hoisting height of a load 70 lifted with the cable winch device 10 and the turn of the cable 30 on the cable winch 20 is automatically recognizable and detectable both directly and indirectly. The position detection means 60 is part of the electronic actuating means 50.

By tilting the cable winch 20 preferably by at least the angle of the range of ascent of the cable 30 on the flanged wheel, the main working range can moved out of this region. The hoisting height correction is effected via the lifting/lowering function of the cable winch drive means 22, i.e. in the exemplary embodiment shown in FIG. 1 via the lifting/lowering function of the hoisting gear 22.

As both the current hoisting height and the turn of the cable 30 on the cable winch 20 are detected automatically via the crane controller 50 by means of the position detection means 60, this compensation can be effected without manual intervention of the crane operator. The system provides for the cable-conserving operation, for example without having to make a change in the boom position. As a result, no change in the lifting capacity must be observed.

The invention claimed is:

1. A cable winch device (10) of a crane with at least one cable winch (20), with at least one cable (30), wherein the cable (30) is at least partly wound up on the cable winch (20) and/or can be wound up and/or unwound, and with at least one tilting means (40) by which the cable winch (20) can at least partly be tilted and/or pivoted about an axis (A) which is substantially parallel to the longitudinal axis of the cable winch (20).

2. The cable winch device (10) according to claim 1, wherein at least one electronic actuating means (50) is provided, by which the tilting means (40) can be actuated.

3. The cable winch device (10) according to claim 2, wherein at least one position detection means (60) is provided, by which the current hoisting height of a load (70) lifted with the cable winch device (10) and/or the turn of the cable (30) on the cable winch (20) is directly and/or indirectly recognizable and/or detectable.

4. The cable winch device (10) according to claim 3, wherein the current hoisting height of a load (70) lifted with the cable winch device (10) and/or the turn of the cable (30) on the cable winch (20) is automatically recognizable and/or detectable by the at least one position detection means (60).

5. The cable winch device (10) according to claim 4, wherein the at least one position detection means (60) is connectable and/or connected with the electronic actuating means (50) and/or that the position detection means (60) is part of the electronic actuating means (50).

6. The cable winch device (10) according to claim 5, wherein the at least one tilting means (40) includes at least one tilt joint (42) and/or at least one drive means (44).

7. The cable winch device (10) according to claim 4, wherein the at least one tilting means (40) includes at least one tilt joint (42) and/or at least one drive means (44).

8. The cable winch device (10) according to claim 3, wherein the at least one position detection means (60) is connectable and/or connected with the electronic actuating means (50) and/or that the position detection means (60) is part of the electronic actuating means (50).

9. The cable winch device (10) according to claim 8, wherein the at least one tilting means (40) includes at least one tilt joint (42) and/or at least one drive means (44).

10. The cable winch device (10) according to claim 3, wherein the at least one tilting means (40) includes at least one tilt joint (42) and/or at least one drive means (44).

11. The cable winch device (10) according to claim 1, wherein at least one position detection means (60) is provided, by which the current hoisting height of a load (70) lifted with the cable winch device (10) and/or the turn of the cable (30) on the cable winch (20) is directly and/or indirectly recognizable and/or detectable.

12. The cable winch device (10) according to claim 11, wherein the current hoisting height of a load (70) lifted with the cable winch device (10) and/or the turn of the cable (30) on the cable winch (20) is automatically recognizable and/or detectable by the at least one position detection means (60).

13. The cable winch device (10) according to claim 12, wherein the at least one position detection means (60) is connectable and/or connected with an electronic actuating means (50) and/or that the position detection means (60) is part of the electronic actuating means (50).

14. The cable winch device (10) according to claim 13, wherein the at least one tilting means (40) includes at least one tilt joint (42) and/or at least one drive means (44).

15. The cable winch device (10) according to claim 12, wherein the at least one tilting means (40) includes at least one tilt joint (42) and/or at least one drive means (44).

16. The cable winch device (10) according to claim 11, wherein the at least one position detection means (60) is connectable and/or connected with an electronic actuating means (50) and/or that the position detection means (60) is part of the electronic actuating means (50).

17. The cable winch device (10) according to claim 16, wherein the at least one tilting means (40) includes at least one tilt joint (42) and/or at least one drive means (44).

18. The cable winch device (10) according to claim 1, wherein the at least one tilting means (40) includes at least one tilt joint (42) and/or at least one drive means (44).

19. The cable winch device (10) according to claim 1, wherein the cable winch (20) includes at least one cable winch drive means (22) by which the cable winch is rotatable such that the cable (30) can be wound up and/or unwound.

20. A crane with at least one cable winch apparatus (10) according to claim 1.

* * * * *